United States Patent [19]

Magari et al.

[11] 4,234,465

[45] Nov. 18, 1980

[54] DETERGENT COMPOSITION

[75] Inventors: Teruo Magari, Funabashi; Toyoyuki Sato, Tokyo; Masayoshi Nakamura, Koshigaya, all of Japan

[73] Assignee: The Lion Fat & Oil Co., Ltd., Tokyo, Japan

[21] Appl. No.: 24,204

[22] Filed: Mar. 27, 1979

[30] Foreign Application Priority Data

Mar. 30, 1978 [JP] Japan ..... 53-37041

[51] Int. Cl.[3] ..... C11D 1/62; C11D 3/26; C11D 7/32

[52] U.S. Cl. ..... 252/547; 252/8.6; 252/8.8; 252/528; 427/245; 427/394; 428/279

[58] Field of Search ..... 252/528, 547, 8.8, 8.6; 427/245, 394; 428/279

[56] References Cited

U.S. PATENT DOCUMENTS

| | | | |
|---|---|---|---|
| 3,862,058 | 1/1975 | Nirschl et al. | 252/528 X |
| 3,915,882 | 10/1978 | Nirschl et al. | 252/8.6 X |
| 3,936,537 | 2/1976 | Baskerville et al. | 252/528 X |
| 3,951,879 | 4/1976 | Wixon | 252/528 X |
| 4,132,680 | 1/1979 | Nicol | 252/547 |
| 4,133,779 | 1/1979 | Hellyer et al. | 252/547 |

*Primary Examiner*—Mayer Weinblatt
*Attorney, Agent, or Firm*—Armstrong, Nikaido, Marmelstein & Kubovcik

[57] ABSTRACT

Detergent compositions containing, as two essential ingredients, the alkaline earth metal salts of anionic surface-active agents having a sulfonic acid group or a sulfuric acid ester group and quaternary ammonium salt type cationic surface-active agents are presented. These detergent compositions can exhibit satisfactory fabric-softening effects for fabrics, without causing a substantial decrease in the cleansing effect.

4 Claims, No Drawings

DETERGENT COMPOSITION

BACKGROUND OF THE INVENTION

1. Field of the Invention

The present invention relates to a detergent composition capable of softening fabrics to be washed during a fabric laundering operation.

2. Description of the Prior Art

Detergent compositions for laundering fabrics known in the art usually contain anionic surface-active agents in combination with builders. However, in the case where fabrics, particularly cotton underwear, diapers and the like are washed by using such detergent compositions, the dried fabrics so washed are stiff and do not exhibit a soft finish. In the case of synthetic fiber products, the washed and dried fabrics tend to be statically charged. As is well-known, a static charge on clothes causes an unpleasant feeling when the clothes are put on and taken off, and also, tends to cause the clothes to be dusty.

For the above-mentioned reasons, in order to prevent the static charge on fabrics which are washed by using the above-mentioned type conventional detergent composition and to impart a good feel and drape to the fabrics, fabrics which are washed are generally treated with a fabric softening composition containing, as a main ingredient, a cationic surface-active agent, after the completion of a rinse step in a fabric laundering operation. However, the fabric softening composition cannot be used simultaneously when fabrics are washed by using the above-mentioned conventional detergent composition. This is because not only is a precipitation caused by the interaction of the cationic surface-active agent present in the softening composition with the anionic surface-active agent present in the detergent composition, but also fabric-softening effects, detergency and frothing power are remarkably impaired.

It has been proposed that nonionic surface-active agents, amphoteric surface-active agents or oil components which do not react with the anionic surface-active agents be incorporated into the detergent compositions, so that a good feel and drape is imparted to fabrics during the laundering operation. However, since the above-mentioned additives are poor in adsorption properties with respect to fabrics, the fabric-softening effects are not good, and, even if a large amount of the above-mentioned additives is incorporated into the detergent composition, satisfactory effects can still not be obtained.

A detergent composition containing both an anionic surface-active agent and an cationic surface-active agent in the presence of the specified clay compound has also been proposed (see: U.S. Pat. Nos. 3,862,058 and 3,915,882). A detergent composition in which the reaction of a cationic surface-active agent with an anionic surface-active agent is suppressed by admixing the cationic surface-active agent with a solid organic material slightly soluble in water has been further proposed (see: U.S. Pat. No. 3,936,537). Although these proposed detergent compositions exhibit fabric-softening effects to some extent, they are still not a satisfactory solution for the present requirements in the art.

SUMMARY OF THE INVENTION

The object of the present invention is to provide a detergent composition which can exhibit sufficient fabric-softening effects in fabrics simultaneously with the washing of the fabrics.

Other objects and advantages of the present invention will be apparent from the description set forth hereinbelow.

In accordance with the present invention, there is provided a detergent composition comprising, as essential ingredients, (i) 5 to 40% by weight of at least one component selected from the group consisting of the alkaline earth metal salts of anionic surface-active agents having a sulfonic acid group or sulfuric acid ester group, and (ii) 0.5 to 10% by weight of at least one component selected from the group consisting of quaternary ammonium compounds having the general formula:

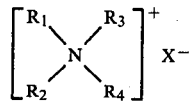

wherein $R_1$ and $R_2$ independently represent an alkyl or alkenyl group having 10 to 22 carbon atoms, $R_3$ and $R_4$ independently represent an alkyl group having 1 to 3 carbon atoms and X represents a halogen atom.

DESCRIPTION OF THE PREFERRED EMBODIMENTS

The detergent composition of the present invention can additionally comprise 40 to 80% by weight of any conventional detergent ingredients (including the other surface-active agents) known in the art.

It has now been found that, even if the alkaline earth metal salts of the specified anionic surface-active agents and the quaternary ammonium salt type cationic surface-active agents coexist in a wash liquor, they only slightly react with each other and no substantial decreases in the cleansing and softening effects are observed.

Although the chemical nature of the present detergent composition in a wash liquor is by no means completely understood, it is believed to be as follows. It is known that fabrics to be washed are negatively charged in a washing liquid. In the case where a laundering operation is carried out by using a detergent composition containing both a cationic surface-active agent and an anionic surface-active agent, it is thought that the cationic surface-active agent is simultaneously subjected to (i) the reaction with the anionic surface-active agent and (ii) the adsorption into the fabrics being washed. Therefore, in a case where a pair ion of the anionic surface-active agent is an alkali metal ion, since this surface-active agent is dissociated concurrently with the dissolution thereof into water, the above-mentioned reaction (i) preferentially takes place to form the water-insoluble salts. However, when the pair ion of the anionic surface-active agent is an alkaline earth metal ion, the dissociation thereof in water becomes very small and, thus, the anionic surface-active agent acts as a nonionic surface-active agent. As a result, the above-mentioned adsorption (ii) takes place in preference to the reaction (i) and, therefore, it is thought that no substantial decreases in either the cleansing or fabric-softening effects are observed.

The alkaline earth metal salts of anionic surface-active agents having a sulfonic acid group or sulfuric acid ester group employed in the present invention preferably include:

(a) alkyl benzene sulfonates having 9 to 15 carbon atoms in the alkyl group, such as, for example, dodecyl benzene sulfonate, tridecyl benzene sulfonate, tetradecyl benzene sulfonate and the like;

(b) α-olefin sulfonates having 10 to 20 carbon atoms, such as, for example, 1-hexadecene sulfonate, 1-octadecene sulfonate and the like (α-olefin sulfonates usually contains mainly alkenyl sulfonates and hydroxyalkane sulfonates as well as relatively small amounts of disulfonates);

(c) alkyl sulfuric ester having 8 to 20 carbon atoms in the alkyl group, such as, for example, lauryl sulfate, dodecyl sulfate, oleyl sulfate and the like;

(d) alkyl ether sulfuric esters having 10 to 18 carbon atoms in the alkyl group and having an average addition mol number of ethylene oxide of 1 to 10, such as, for example, polyoxyethylene lauryl ether sulfate (E.0. $\bar{p}=3$) and the like;

(e) alkane sulfonates having 10 to 20 carbon atoms in the alkyl group, such as, for example, hexadecane sulfonate, octadecane sulfonate and the like;

(f) α-sulfoalkyl ester having 11 to 22 carbon atoms, such as, for example, methyl α-sulfo stearate, methyl α-sulfo palmitate and the like. These compounds can be used alone or in any conbination thereof in the present invention.

The alkaline earth metal salt of the aniomic surface-active agent is incorporated into the detergent composition of the present invention in an amount of from 5 to 40% by weight, and preferably, from 15 to 35% by weight, based on the total weight of the detergent composition. When the amount of the alkaline earth metal salt of the anionic surface-active agent is less than 5% by weight, satisfactory cleansing effects cannot be obtained, whereas when the amount of the alkaline earth metal salt of the anionic surface-active agent is more than 40% by weight, fabric softening effects unpreferably decrease. Although the alkaline earth metal salt of the anionic surface-active agent can be typically used in the form of either of the calcium salt or the magnesium salt, the magnesium salt can be most preferably incorporated into the detergent composition of the present invention in view of the frothing property and detergency of the detergent composition.

The quaternary ammonium compounds of the aforementioned general formula employed in the present invention preferably include dimethyl distearyl ammonium chloride, dimethyl dipalmityl ammonium chloride, dihydrogenated tallow dimethyl ammonium chloride and the like. As is clear from the general formula set forth hereinabove, the quaternary ammonium compound type cationic surface-active agents employed in the present invention are di-lower alkyl type quaternary ammonium compounds and, when the other type quaternary ammonium compounds are used, it is not expected to provide sufficient fabric-softening effects in fabrics. These compounds can be used alone or in any combination thereof in the present invention.

The quaternary ammonium compound of the general formula set forth hereinabove is incorporated into the detergent composition of the present invention in an amount of from 0.5 to 10% by weight, and preferably, from 1 to 7.5% by weight, based on the total weight of the detergent composition. When the amount of the quaternary ammonium compound is less than 0.5% by weight, satisfactory fabric-softening effects can not be obtained. On the other hand, when the amount of the quaternary ammonium compound is more than 10% by weight, satisfactory cleansing effects cannot be obtained.

The inventors of the present invention prefer to use the detergent composition in the particle form. The method of the preparation of the individual components of the detergent composition and of the detergent composition incorporating them can be carried out in any conventional manner well known in the art. For example, when the detergent composition in the form of particles is formulated, the cationic surface-active agent can be separately granulated into discrete particles, followed by incorporating them into the particles of a detergent composition containing the anionic surface-active agent(s).

Although the detergent composition of the present invention should contain the specified amounts of both the anionic surface-active agent having a sulfonic acid group or sulfuric acid ester group and the quaternary ammonium salt type surface-active agent of the formula set forth hereinabove, the other conventional detergent ingredients containing other surface-active agents and detergent additives can be incorporated into the detergent composition of the present invention as long as the above-mentioned requirements are fulfilled.

The other surface-active agents optionally employed in the present invention include, for example, nonionic surface-active agents, such as alcohol ethoxylate and alkyl phenol ethoxylate, each having 8 and 15 carbon atoms in the alkyl group and having an average addition mol number of ethylene oxide of 5 to 15, and; ampholytic surface-active agents, such as alkyl betaine, alkyl sulfobetaine and the like.

The typical detergent additives which can be incorporated into the detergent composition of the present invention include, for instance, inorganic detergency builders, such as sodium silicate, sodium carbonate, sodium tripolyphsphate, sodium pyrophosphate, sodium orthophosphate, aluminosilicate and the like; organic detergency builders, such as polycarboxylates (e.g. salts of the polymers of maleic anhydride, acrylic acid and the like and salts of the copolymer of those acids and suitable olefins), sodium nitrilotriacetate, sodium citrate and the like. These detergencey builders can be used, in an amount of 40 to 80% by weight and, preferably, 50 to 70% by weight, based on the total weight of the detergent composition.

Examples of other detergent additives optionally incorporated into the detergent composition of the present invention are organic chelating agents, such as E.D.T.A. and the like; anti-caking agents, such as benzene sulfonate, toluene sulfonate, xylene sulfonate, aluminum sulfate, magnesium sulfate and the like; optical brightening agents; perfumes; colouring agents; suds control agents such as soap; redeposition preventing agents such as carboxymethyl cellulose (CMC), polyethylene glycol (PEG), polyvinyl alcohol (PVA) and the like.

The present invention now will be further illustrated by, but is by no means limited to, the following Examples.

EXAMPLES 1 through 21

The detergency and fabric-softening effects of the various detergency compositions listed in Table 1 below were evaluated in the following manner.

(1) Detergency Test

Sample fabrics (a broad cloth woven from a cotton yarn of 60 cotton count) were attached to necks of shirts. The shirts were worn for 2 through 7 days and, then, the soiled sample fabrics were removed from the necks of the shirts. Soiled cotton underwear which were worn for 2 or 3 days were also prepared.

20 sheets of the soiled sample fabrics, as well as the soiled cotton underwear, and clean cotton towels were washed in a wash liquid containing 0.13% by weight of each detergent composition listed in Table 1, for 10 minutes, under the conditions of a liquid temperature of 25° C. and a ratio of the washing liquid volume to the cloth volume (i.e. bath ratio) of 30, and then, were each rinsed twice for 3 minutes. The detergency of each detergent composition listed in Table 1 was determined by measuring the ratio of the light reflex of the sample fabrics before and after washing.

The results are shown in Table 1, in which the detergency of each detergent composition is shown as an index with reference to the value of Example 5. (the detergent composition of Example No. 5 is one of the most typical detergents in the art.).

(2) Fabric-softening Test

Fabric-softening effects of the detergent compositions listed in Table 1 were determined with respect to air dried the cotton towels which were used in the above detergency test by a sensory test using a panel consisting of 10 members (tactile impression). The results were scored as follows.

| | | |
|---|---|---|
| (a) | The impression of the fabric which was washed with a commercially available detergent composition*1 followed by being treated with a commercially available softer*2 | 2 |
| (b) | The intermediate between (a) and (c) | 1 |
| (c) | The impression of the fabric which was washed with the commercially available detergent composition without using a softer. | 0 |

*1BLUE DIA (THE LION FAT & OIL CO., LTD)
*2SOFRUN-S (THE LION FAT & OIL CO., LTD)

The results are shown in Table 1 in terms of the total points of the panel.

TABLE 1

| Compsition (Parts by weight) | Example No. 1*1 | 2*1 | 3 | 4 | 5*1 | 6 | 7*1 | 8 | 9*1 | 10 | 11 |
|---|---|---|---|---|---|---|---|---|---|---|---|
| LAS-½ Mg*2 | — | — | 20 | 20 | — | — | — | — | 20 | 20 | 20 |
| LAS-Na*2 | 20 | 20 | — | — | — | — | — | — | — | — | — |
| AOS-½ Mg*3 | — | — | — | — | — | 20 | — | — | — | — | — |
| AOS-Na*3 | — | — | — | — | 20 | — | — | — | — | — | — |
| AES-½ Mg*4 | — | — | — | — | — | — | — | 20 | — | — | — |
| AES-Na*4 | — | — | — | — | — | — | 20 | — | — | — | — |
| Sodium Tripolyphosphate | 20 | 20 | 20 | 20 | 20 | 20 | 20 | 20 | 20 | 20 | 20 |
| Sodium Carbonate | 15 | 15 | 15 | 15 | 15 | 15 | 15 | 15 | 15 | 15 | 15 |
| Cationic Surfactant*5 | — | 5 | 5 | 2 | — | 5 | — | 5 | — | 1 | 7.5 |
| Water | 10 | 10 | 10 | 10 | 10 | 10 | 10 | 10 | 10 | 10 | 10 |
| Sodium Sulfate | balance | balance | balance | balance | balance | balance | balance | balance | balance | balance | balance |
| Fabric-Softening Effect (Point) | 0 | 0 | 16 | 9 | 2 | 12 | 0 | 10 | 2 | 8 | 15 |
| Detergency (Index) | 100 | 91 | — | — | 100 | 98 | 102 | — | — | — | — |

| Composition (Parts by weight) | Example No. 13 | 14 | 15 | 16 | 17 | 18 | 19 | 20 | 21*1 | |
|---|---|---|---|---|---|---|---|---|---|---|
| LAS-½ Mg*2 | — | — | — | 15 | 30 | 35 | — | — | — | — |
| LAS-Na*2 | — | — | — | — | — | — | — | — | — | — |
| AOS-½ Mg*3 | 20 | 20 | 20 | — | — | — | 15 | 30 | 35 | — |
| AOS-Na*3 | — | — | — | — | — | — | — | — | — | 20 |
| AES-½ Mg*4 | — | — | — | — | — | — | — | — | — | — |
| AES-Na*4 | — | — | — | — | — | — | — | — | — | — |
| Sodium Tripolyphosphate | 20 | 20 | 20 | 20 | 20 | 20 | 20 | 20 | 20 | 20 |
| Sodium Carbonate | 15 | 15 | 15 | 15 | 15 | 15 | 15 | 15 | 15 | 15 |
| Cationic Surfactant*5 | — | 2.5 | 3.5 | 5 | 5 | 5 | 5 | 5 | 5 | 5 |
| Water | 10 | 10 | 10 | 10 | 10 | 10 | 10 | 10 | 10 | 10 |
| Sodium Sulfate | balance | balance | balance | balance | balance | balance | balance | balance | balance | balance |
| Fabric-Softening Effect (Point) | 1 | 8 | 10 | 14 | 11 | 11 | 12 | 9 | 10 | 0 |
| Detergency (Index) | 99 | 99 | — | — | — | — | — | — | — | 93 |

*1Comparative Example
*2LAS = Alkyl Benzene Sulfonate (Ave. Alkyl $C_{12}$)
*3AOS = α-Olefin Sulfonate (Ave. $C_{16.8}$)
*4AES = Polyoxyethylene($\bar{p}$ = 3) Lauryl Ether Sulfate
*5Dihydrogenated Tallow Dimethyl Ammonium Chloride As is clear from the results shown in Table 1, the detergency of the detergent compositions of Examples 1, 5, 6, 7, 12, and 13 were good. On their other hand, as is also clear from the results shown in Table 1, the detergent compositions of Examples 3, 4, 6, 8, 10, 11 and 13 through 20 (according to the present invention) exhibited satisfactory fabric-softening effects in the fabrics. Contrary to this, the detergent compositions of Examples 1, 2, 5, 7, 9, 12 and 21, containing the sodium salt of the anionic surface-active agents or containing no cationic surface-active agents, could not impart a good fabric-softening effect to the fabrics.

What we claim is:

1. A detergent composition consisting essentially of, as essential ingredients, (i) 5 to 40% by weight of at least one component selected from the group consisting of a magnesium salt of anionic surface-active agents having a sulfonic acid group of sulfuric acid ester group, and (ii) 2 to 7.5% by weight of at least one component selected from the group consisting of quaternary ammonium compounds having the general formula:

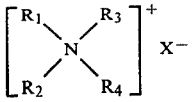

wherein $R_1$ and $R_2$ independently represent an alkyl or alkenyl group having 10 to 22 carbon atoms, $R_3$ and $R_4$ independently represent an alkyl group having 1 to 3 carbon atoms and X represents a chlorine atom.

2. A detergent composition as claimed in claim 1, wherein said composition further contains 40 to 80% by weight of conventional detergent ingredients selected from the group consisting of nonionic surface-active agents, amphoteric surface-active agents, inorganic and organic builders, organic chelating agents, anti-caking agents, optical brightening agents, perfumes, colouring agents, suds control agents and redeposition preventing agents.

3. The detergent composition according to claim 1 wherein the surface-active agent is selected from at least one member of the group consisting of alkyl benzene sulfonates having from 9 to 15 carbon atoms in the alkyl group, α-olefin sulfonates having from 10 to 20 carbon atoms, alkyl sulfuric esters having from 8 to 20 carbon atoms in the alkyl group, alkyl ether sulfuric esters having from 10 to 18 carbon atoms in the alkyl group and having an average mole number of ethylene oxide of from 1 to 10, alkane sulfonates having from 10 to 20 carbon atoms in the alkyl group and α-sulfoalkyl esters having from 11 to 22 carbon atoms.

4. The detergent composition according to claim 3 wherein the surface-active agent is selected from at least one member of the group consisting essentially of dodecyl benzene sulfonate, tridecyl benzene sulfonate, tetradecyl benzene sulfonate, 1-hexadecene sulfonate, 1-octadecene sulfonate, lauryl sulfate, dodecyl sulfate, oleyl sulfate, polyoxyethylene lauryl ether sulfate, hexadecane sulfonate, octadecane sulfonate, methyl α-sulfo stearte and methyl α-sulfo palmitate.

* * * * *